United States Patent [19]

Johnson

[11] Patent Number: 4,643,073

[45] Date of Patent: Feb. 17, 1987

[54] MUZZLE STABILIZATION ARRANGEMENT FOR FIREARMS

[76] Inventor: Harold E. Johnson, 505 Adelman Cir., Vienna, Va. 22180

[21] Appl. No.: 633,217

[22] Filed: Jul. 23, 1984

[51] Int. Cl.[4] ..... F41F 17/12

[52] U.S. Cl. ..... 89/14.3; 89/14.4

[58] Field of Search ..... 89/14.2, 14.3, 14.4; 181/223

[56] References Cited

U.S. PATENT DOCUMENTS

| | | | |
|---|---|---|---|
| 1,227,897 | 5/1917 | Dunwoody | 89/14.3 |
| 3,380,344 | 4/1968 | Bucklisch et al. | 89/14.3 |
| 4,341,283 | 7/1982 | Mazzanti | 89/14.4 |

FOREIGN PATENT DOCUMENTS

| | | | |
|---|---|---|---|
| 23571 | of 1914 | United Kingdom | 89/14.2 |

*Primary Examiner*—Deborah L. Kyle
*Assistant Examiner*—John S. Maples
*Attorney, Agent, or Firm*—Radford W. Luther; Richard A. Dornon

[57] ABSTRACT

A muzzle stabilization arrangement for a rifle (10) with a barrel (14) includes a muzzle stabilizer (18) mounted on the front end of the barrel and having a transverse opening (80) partially defined by a surface (84) upon which propellant gases from the muzzle may impinge during firing to hold the muzzle down. Gas ports (38, 40) in the barrel supply propellant gas to orifices (62, 64) in the stabilizer which direct a gas screen over the opening to prevent excessive noise.

5 Claims, 8 Drawing Figures

MUZZLE STABILIZATION ARRANGEMENT FOR FIREARMS

TECHNICAL FIELD

This invention relates to muzzle stabilizers for firearms.

BACKGROUND ART

Existing muzzle brakes and compensators employed to counteract the inherent tendency of a firearm to move or jump upwardly upon firing can produce unacceptable noise levels at a shooter's ear although many are capable of performing their intended function with some success.

While there have been attempts to reduce noise levels in firearms by bleeding propellant gases over openings in a muzzle device screwed upon the muzzle of the firearm, the provision of such a device has resulted in an inordinate increase in the length of the firearm. Moreover, such attempts have met with limited success because a bullet travelling in space after exiting the muzzle, but within the confines of the muzzle device, mandated upward venting of gases to insure alignment of the bullet with the exit hole of the muzzle device; and this venting of supersonic gases in and of itself significantly contributed to increased noise levels.

DISCLOSURE OF THE INVENTION

In accordance with the invention, there is provided for a firearm a muzzle stabilization arrangement which taps propellant gases from the barrel of the firearm at a point rearward of the muzzle and directs them forward over the openings of a stabilizer mounted upon the end of the barrel. The stabilizer is constructed and arranged such that the tapped gas flow is maintained close to the sides of the stabilizer for efficient operation thereof. A muzzle stabilization arrangement of the invention is advantageous because it not only reduces muzzle movement upon firing but also occasions reduced noise levels at a shooter's ear, when contrasted to conventional muzzle brakes.

Accordingly, it is a primary object of the invention to provide a muzzle stabilization arrangement for a firearm which does not produce unacceptable noise levels.

This and other objects and advantages of the invention will become more readily apparent from the following detailed description when taken in conjunction with the accompanying drawings, in which:

BEST MODE OF CARRYING OUT THE INVENTION

Figure 1:
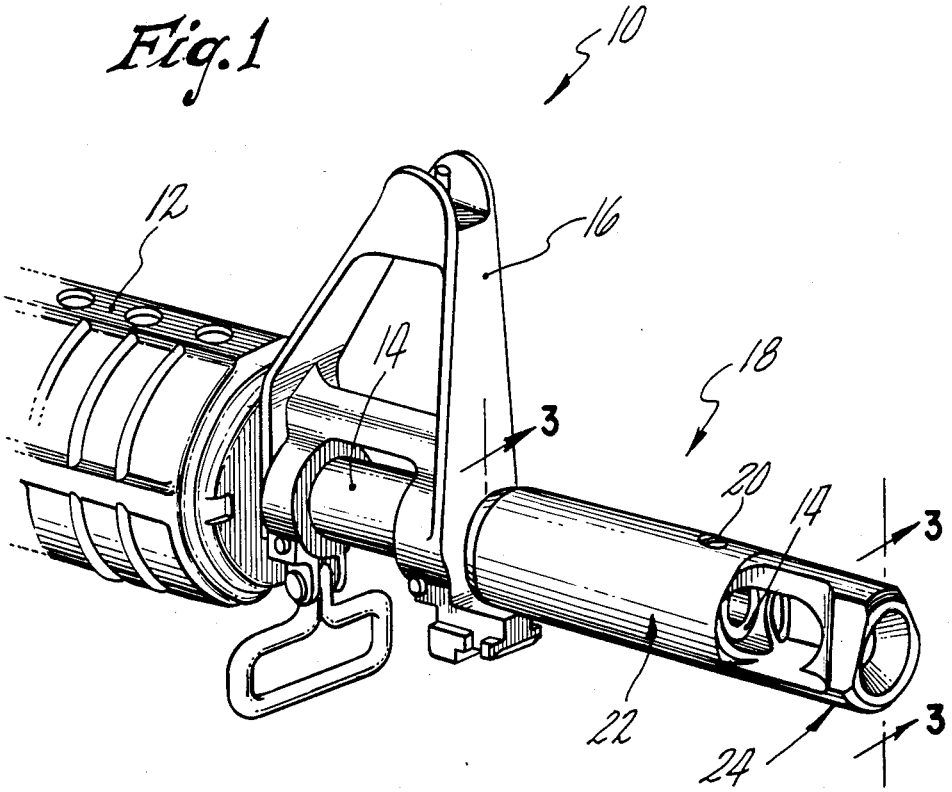
FIG. 1 is a perspective view of the front portion of a rifle incorporating a muzzle stabilization arrangement of the invention.

Referring to FIG. 1, there is shown a muzzle stabilization arrangement on the forward or front end of a rifle, generally designated 10. The rifle 10 incorporates a handguard 12 which surrounds a segment of a barrel 14. Carried upon the barrel 14 is the usual front sight 16. The forwardmost portion of the barrel 14 incorporates a muzzle stabilization arrangement constituted by specially machined elements on the barrel 14 and a muzzle stabilizer, generally shown at 18. The muzzle stabilizer 18 is threadably secured to the front portion of the barrel 14 and held in the depicted angular orientation by means of a set screw 20 or other locking device. The muzzle stabilizer 18 is preferably formed by two sections, viz.: a first cylindrical expansion chamber section 22 and a second nozzle section 24 which are in threaded engagement and maintained in such engagement in the proper angular and axial relationship by the set screw 20.

Figures 3, 4, 5, 6, 7, 8:
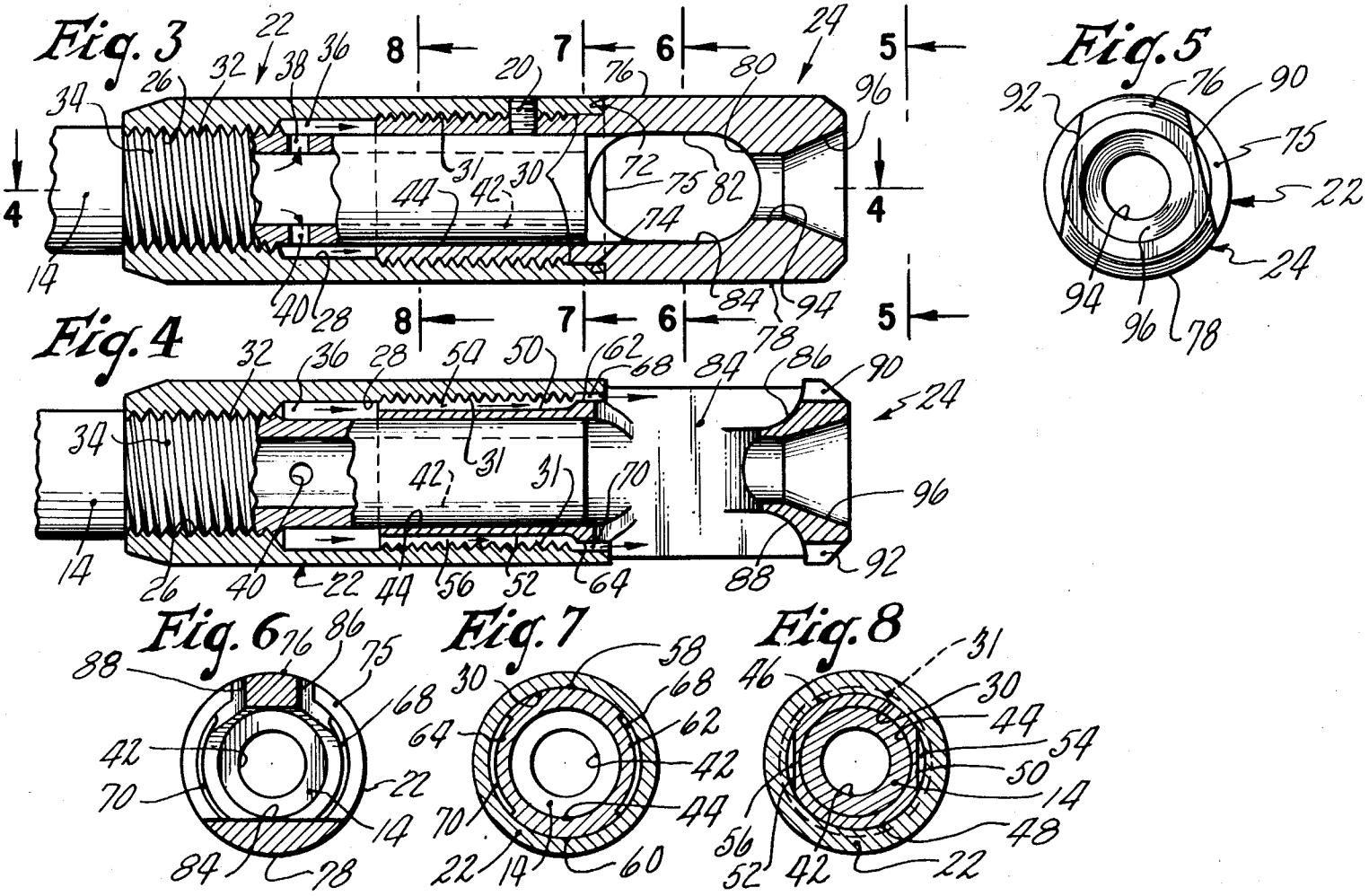
FIG. 3 is a sectional, side elevational view of the front portion of the firearm of FIG. 1, taken substantially along the line 3—3 of FIG. 1.
FIG. 4 is a sectional, top plan view of the front portion of the firearm of FIG. 1.
FIG. 5 is a front elevational view of the muzzle end of the firearm of FIG. 1, taken substantially along the line 5—5 of FIG. 3.
FIGS. 6–8 are transverse sectional views of the front portion of the firearm of FIG. 1, taken substantially along the respective lines 6—6, 7—7 and 8—8 of FIG. 3.

With reference to FIGS. 3 and 4, it will be seen that the first section 22 comprises three communicating bores of progressively increasing diameter, i.e., bore 26, bore 28 and bore 30. Bore 26 has internal threads 32 which mate with external threads 34 formed upon a segment of the barrel 14 to thereby mount the stabilizer 18 thereupon. The bore 28 is smooth and defines, with the coextensive outer periphery of the barrel 14, an annular volume 36. Radially extending gas ports 38 and 40 are provided in the barrel 14 adjacent the annular volume 36 to supply propellant gases from the bore 42 of the barrel to the annular volume. Bore 30 includes internal threads 31 into which the second section is screwed.

Figure 2:
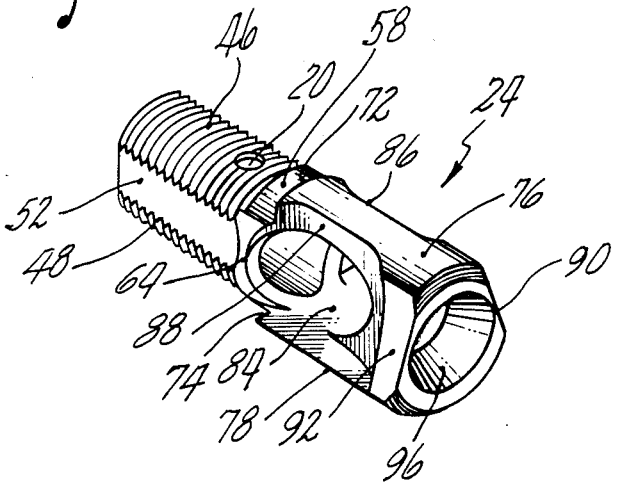
FIG. 2 is a perspective view of the nozzle section of the muzzle stabilizer shown in FIG. 1.

The second nozzle section 24 is more geometrically complex than the first section 22 and is shown, per se, in FIG. 2 where its construction may best be appreciated in conjunction with reference to FIG. 5. The rear segment of the second section 24 has an internal bore 44 passing therethrough which engages the outer periphery of the barrel 14 in a snug fit to thereby forestall any gas flow therebetween. The outer periphery of the rear segment of the second section 24 has top and bottom threaded portions 46 and 48, respectively, which are in threaded engagement with the threads 31 on the interior of the bore 30. Disposed between the threaded portions 46 and 48 are flat surfaces 50 and 52 (which could be flat or convex) milled upon the rear segment so as to define, with the bore 30, two side channels 54 and 56 (see FIGS. 4 and 8) for receiving propellant gas from the annular volume. From FIGS. 2 and 3, it will be noted that the set screw 20 extends through aligned tapped holes in the first section 22 and the second section 24 into clamping engagement with the outer periphery of the barrel 14.

As shown in FIGS. 2, 3 and 7 the rear segment of the second section 24 has top and bottom unthreaded cylindrical surface portions 58 and 60 respectively which tightly seal the forwardmost unthreaded, cylindrical, inner periphery of the bore 30 whereby no propellant gas may pass therethrough. Adjoining the cylindrical surface portions 58 and 60 (but of slightly less radius) and disposed on the sides of the second section 24 are cylindrical surface portions 62 and 64 which cooperate with the forwrdmost inner periphery of the bore 30 to define two orifices 68 and 70 through which propellant is bled over the forward segment of the second section 24. Shoulders 72 and 74, as best shown in FIG. 4, are in abutting relationship with the circular lip 75 at the front end of the first section whereby the outer peripheral surface of the first section is flush with the outer peripheral surface of the second section as illustrated in FIGS. 1, 3 and 4. It is important to note that the forwardmost inner peripheral surface of the bore 30 extends slightly beyond the orifices 68 and 70 to hold the gas screen emanating therefrom close to the exterior of the second section to optimize muzzle stabilization, reduce recoil and lessen noise at a shooter's ear.

Turning to FIGS. 1, 2, 5 and 6, the forward segment of the second section 24 has top and bottom cylindrical surface portions 76 and 78, respectively, which are flush with the outer peripheral surface of the first section 22 as previously noted. With reference to FIGS. 1, 2 and 3, an elongated transverse opening 80 having flat upper and lower surfaces 82 and 84, respectively, and semicircular sides is milled in the forward segment of the second section 24 and extends completely therethrough. As shown in FIGS. 2 and 6, the sides of the forward segment of the second section 24 are milled to provide inward relief to the inwardly bowed sidewalls 86 and 88 and to provide lateral extensions to the lower flat surface 84 upon which the gases emanating from the muzzle of the barrel 14 impinge. Planar surfaces 90 and 92 are machined on the front end of section 24 to furnish relief which aids in the turning forward by the gas screen of reciprocating gases. The area of the planar surfaces 90 and 92 can be varied to provide the desired degree of recoil and blast noise reduction. It will be seen from FIGS. 2, 3, 4 and 5 that the front end of the second section 24 has a bore 94 through which a bullet from the barrel 14 may pass and a conical opening 96 in communication therewith. It will be appreciated the provision of the conical opening 96 is highly desirable because such a feature minimizes the time and distance during which a bullet travels within the confines of the stabilizer, thereby reducing the likelihood of the bullet contacting the stabilizer in the event of relative motion between the bullet and the stabilizer after the bullet has exited the muzzle.

It will thus be appreciated that a muzzle stabilizer of the invention is unique in that it obtains propellant gases for its functioning at a point rearward of the muzzle and has structure to insure that the gas screen generated during firing is held close to sides of the stabilizer for most efficient operation.

Preferably, a stabilizer of the invention will be constructed from 4140 steel, unheattreated, with a matt rust-resistant black finish. However, those skilled in the art will appreciate that other materials could also be employed in the stabilizer's construction.

Upon firing the rifle 10, gases from the bore 42 of the barrel 14 proceed to the annular volume 36 via the gas ports 38 and 40. From this location, the propellant gases expand forwardly through the channels 54 and 56 and emerge from the orifices 68 and 70 as a gas screen which is generally parallel or coaxial with the bore 42 and laterally confined and held close to the sides of the stabilizer by the forwardmost inner periphery of the bore 30. The high pressure supersonic gases emerging from the muzzle of the barrel 14 are restrained, to some extent, from flowing in the axial direction by surfaces 86 and 88. The transverse opening 80 offers little resistance to the expanding gases, much of which now flows through opening 80. The general direction of gas flow is now changed and the resultant direction of gas flow is no longer diagionally foreward, but is radial or actually rearward. By diverting the gas flow in this manner, the gases impinge on surface 84 to hold the muzzle down and upon surfaces 86 and 88 to reduce recoil. The radial movements of the supersonic gases exiting opening 80 create supersonic shock waves in the surrounding air that normally are disconcerting, if not outright injurious, to a shooter. In the present muzzle brake, however, these gases are intercepted close to the exterior surfaces of the muzzle brake by the gas screen from orifices 68 and 70 and vectored foreward, thereby curtailing the formation of the supersonic shock waves and apparently blowing any excess noise forewardly and away from a shooter.

Obviously, many modifications and variations are possible in light of the above teachings without departing from the scope or spirit of the invention as defined in the appended claims.

I claim:

1. A muzzle stabilization arrangement for a firearm having a barrel with a bore comprising:

a muzzle stabilizer having a first section mounted upon the barrel and a second section forming a rigid extension of said first section, said second section extending forwardly of the muzzle of the barrel and having an opening extending transversely therethrough in front of the muzzle of the barrel, the transverse opening being at least partially defined by a lower surface for being contacted by propellant gases from the barrel;

passage means defined between the muzzle stabilizer and the outer periphery of the barrel for directing a gas screen in coaxial relationship to the bore over the opening in the stabilizer; and a radially extending gas port in the barrel rearward of the muzzle of the barrel in fluid communication with the bore of the barrel and the passage means for supplying propellant gases thereto.

2. A muzzle stabilization arrangement, as defined in claim 1, wherein the passage means comprises:

an annular volume in communication with the gas port; two channels in communication with the annular volume; and two orifices in respective communication with the channels.

3. A muzzle stabilization arrangement, as defined in claim 1, further comprising:

surface means forward of the passage means to hold the gas screen close to the opening of the stabilizer.

4. A muzzle stabilization arrangement, as defined in claim 1, wherein the front of the muzzle stabilizer has a conical opening therein and a bore which communicates with the conical opening, the conical opening reducing the likelihood of a bullet from the muzzle contacting the muzzle stabilizer.

5. A muzzle stabilization arrangement, as defined in claim 1, wherein the front of the muzzle stabilizer comprises:

inwardly bowed sidewalls upon which the gases emanating from the muzzle of the barrel impinge to reduce recoil.

* * * * *